US012768566B2

(12) United States Patent
Cannon et al.

(10) Patent No.: US 12,768,566 B2
(45) Date of Patent: Oct. 20, 2026

(54) CONDENSATE REUSE FOR HVAC EFFICIENCY IMPROVEMENT

(71) Applicant: Budderfly, Inc., Shelton, CT (US)

(72) Inventors: David Gerald Cannon, Farmerville, LA (US); Kenneth Buda, Scarsdale, NY (US)

(73) Assignee: Budderfly, Inc., Shelton, CT (US)

( * ) Notice: Subject to any disclaimer, the term of this patent is extended or adjusted under 35 U.S.C. 154(b) by 157 days.

(21) Appl. No.: 18/752,075

(22) Filed: Jun. 24, 2024

(65) Prior Publication Data

US 2025/0003629 A1 Jan. 2, 2025

Related U.S. Application Data

(60) Provisional application No. 63/524,345, filed on Jun. 30, 2023.

(51) Int. Cl.

| | |
|---|---|
| ***F24F 13/22*** | (2006.01) |
| ***F24F 11/70*** | (2018.01) |
| ***F24F 13/30*** | (2006.01) |
| *F24F 140/20* | (2018.01) |

(52) U.S. Cl.

CPC ..... *F24F 13/222* (2013.01); *F24F 11/70* (2018.01); *F24F 13/30* (2013.01); *F24F 2013/225* (2013.01); *F24F 2140/20* (2018.01)

(58) Field of Classification Search

CPC .. F24F 2140/20; F24F 2013/225; F24F 13/30; F24F 11/70; F24F 13/222

See application file for complete search history.

(56) References Cited

U.S. PATENT DOCUMENTS

| | | | | |
|---|---|---|---|---|
| 7,150,160 | B2 | 12/2006 | Herbert | |
| 10,605,503 | B2 | 3/2020 | Shan | |
| 2018/0356116 | A1* | 12/2018 | Winders | F24F 13/22 |
| 2020/0208887 | A1* | 7/2020 | Mohammad | F25B 39/04 |

FOREIGN PATENT DOCUMENTS

CN 209857691 U * 12/2019

* cited by examiner

*Primary Examiner* — Ana M Vazquez
(74) *Attorney, Agent, or Firm* — Farber LLC

(57) ABSTRACT

A system for improving the efficiency of HVAC systems by reusing condensate and spraying it onto the coils to cool them. The flow rate of the spray is adjusted based on condensate levels and peak usage, temperature, and cost periods. The system further learns and adapts to the energy usage pattern of the equipment and the condensate levels and optimizes the flow of condensate.

21 Claims, 5 Drawing Sheets

CONDENSATE REUSE FOR HVAC EFFICIENCY IMPROVEMENT

TECHNICAL FIELD OF INVENTION

The present disclosure relates generally to systems and methods for HVAC (Heating Venting and Air-Conditioning) efficiency. More specifically, the efficiency of existing systems is improved by reutilization of the evaporated liquid from the condenser coils of the HVAC or gathered from other sources in conjunction with a timed sprayer to use this liquid to cool the coils at peak usage times.

BACKGROUND OF THE INVENTION

HVAC equipment is one of the largest energy users in commercial establishments that serve the public. Gains in efficiency leading to energy savings, even when small in term of percentage, can lead significant monetary savings. Improved efficiency can also improve the lifespan of the equipment.

In typical HVAC systems, heat is absorbed by the evaporator coil. Warm air, drawn in through a vent, blows over a cold evaporator coil raising the refrigerant temperature. This heat is transferred outside, and the refrigerant gets cold. This process is repeated.

The warm and often humid air that is being blown across the cold coil generates moisture which collects on the evaporator coil and drips into a pan. In most typical systems, this condensate is simply drained to the exterior as a waste byproduct.

While there are other systems that offer ways to capture this condensate and reuse it for irrigation or other purposes, the system and method described herein utilizes the liquid to aid in cooling the condenser coils which are part of the refrigeration cycle by reintroducing the condensate, for example by spraying that condensate over the coils.

Further, in many applications the availability of condensate is limited, and systems that look to use the condensate for other operations such as spraying the coils will often have periods when the condensate has been used up and is unavailable.

While some systems have been envisioned for spraying/misting water over condenser coils to improve their efficiency, the control of that spraying and logic behind it is not workable on a large scale. For example, effective control is important as is winterizing to avoid water in exterior lines that can be frozen to make such a solution workable on a large scale.

U.S. Pat. No. 10,605,503 to Shan describes a process by which condensate is used to cool refrigerant. U.S. Pat. No. 7,150,160 to Herbert teaches a method of using the condensate byproduct in a heat exchanger to provide refrigerant pre-cooling. However, these references do not consider monitoring the temperature of the AC unit or other associated temperatures or sensor data to determine when to spray or what rate to spray at, nor do these references consider peak energy usage periods and the costs associated as part of the system in providing the misted condensate as a cooling method.

SUMMARY OF THE INVENTION

What is desired then is a system and method that can improve the efficiency of condenser-based cooling systems by reusing condensate to cool the coils of HVAC systems through a sprayer using control systems which receive data on temperature, humidity and other operational data and control inputs to effectively implement a condenser cooling system on a large scale using centralized control.

It is further desired to provide a system and method that can utilize the coil spraying system at optimal times, to ensure that the coil cooling mechanism is used at the most expensive rate times and at high use times when the system is running close to its peak capacity or where outside temperatures are appropriate for use of the condensate.

It is still further desired to provide a system and method that can monitor the level of available condensate or coolant in the tray for use and set a schedule for using the condensate for spraying based on a set of prioritized times.

It is still further desired to provide a system and method that is able to pool condensate collection from multiple HVAC units and other compressor-based systems which may produce condensate as well as other systems such as fuel cells that generate water as a biproduct from their normal operation.

It is still further desired to provide a system and method that can monitor the level of available condensate or coolant in the tray for use and set a schedule for using the condensate for spraying based on a set of prioritized target condenser-based systems using a prioritized schedule for use in each target when multiple such systems are in use.

It is still further desired to provide a system and method that can utilize external sensors such as thermostats and humidity level as well as detecting occupancy to influence the schedule and predict the most appropriate times to utilize the condensate.

It is still further desired to provide a system and method that can utilize machine learning to continue to optimize the schedules and predict both the condensate availability as well as the peak needs for cooling.

It is still further desired to provide a system and method that is aware of the utility billing models and that uses the peak usage period data and rate data to determine the most beneficial time to utilize the condensate for spraying the coils.

It is further desired to provide a system that can be drained remotely and/or winterized to avoid damage to the system in cold periods.

The system monitors condensate levels and correlates these to temperature and humidity functions to establish a baseline of expected condensate availability. This baseline is adjusted based on actual measured condensate levels with the help of sensors which will also account for variables such as normal evaporation and/or possible pan leakage or spills.

The system also monitors outside temperature and occupancy levels to determine ideal use and most appropriate use when occupancy is highest and temperature outside is highest. The system can also leverage external feeds such as temperature forecasts to make predictions.

The system can also be aware of billing data such as peak usage, and rate tables to predict cost information so that it can optimize the spraying of condensate where it can help improve operational efficiency when costs are highest, thus reducing costs. The machine learning can be used to predict condensate availability for these times enduring that we can benefit from the system when it is most needed.

As an example, if only 1 gallon of condensate is generated and will only last for 1 hour of spraying, the system will reserve this condensate, accounting for any evaporation, and keep the spray system off except for the key peak periods where either energy costs are the highest or the condensate will help alleviate peak demand.

If there is sufficient condensate, the system will estimate the condensate need and increasingly utilize it for windows where it will provide the most benefit up to and including using it all the time assuming an unlimited supply, Once a piece of equipment is put into service, and the expected baseline has been established, a monitoring exercise that accounts for the duty cycle and operational elements in the environment is created. For example, for a HVAC at a fast-food restaurant, the number of people in the room, the temperature is all used to help establish the baseline.

These elements are fed into the system to influence the priorities in addition to the costing data.

The level of the coolant tank is also measured to determine the approximate length of time the system can be cooled, and the volume of water is managed accordingly as are the hours of operation of the pump.

In one configuration, a system for automatically learning and adapting to the condensate availability according to a control input providing the current level of condensate is disclosed. Further, the system monitors and times the use of condensate over time in various conditions of humidity and device operations and is able to thus predict the usage of the available condensate over time. For example, when the condensate level is at ½ of the 10 gallon tank, and we know that at 100 degrees F. there will be some evaporation of the condensate that accompanies the spraying of the condensate, the amount of time the current level of condensate is available to be used can be calculated. We also know that at the current temperature and humidity level, new condensate is added to the pan at a predictable rate when the system is operating. Using these formulas and with machine learning making the formulas more precise we can prioritize the window of spraying based on the available condensate. In an example, say we know that with the rate of evaporation and the rate of new condensate creation we have enough condensate to spray the coils for 2 hours. We can thus start spraying 1 hour before the peak usage period and spray for 1 hour after the peak usage period maximizing the effect of the condensate. If we had 4 hours of spray time, we would start 2 hours before and continue 2 hours after. Further, if we actually had 8 hours of spray, and the peak period lasted 4 hours, we would spray over the whole peak usage time, and look for secondary peaks when to spray. There may be many peak usage periods such as the following: (a) at lunch time there is a rush of people, the ovens are on, the doors are opening and closing, and it's the hottest time of the day. This is the largest peak period of the day which is top priority for the spraying. (b) when the store opens, all the ovens are pre-heated, the grills are pre-heated, the freezer and refrigerator doors are opened to extract food. This may be the secondary peak period in a priority sense. (c) at dinner time, while it is no longer as hot outside, the influx of people, the opening of the door and the added cooking also create a peak which, if there is enough condensate left to accommodate would also merit spraying. The machine learning may also detect other patterns of use. For example, the facility may start a bread baking cycle to prepare bread in the afternoon if the morning sales were good this repeatable pattern may be picked up. Even dynamic monitoring of energy use can help detect increased activity. The system, knowing that it has enough condensate to cover the known peaks, can decide to spray condensate dynamically in the measured and unexpected peak.

An example system comprises: a computer having a storage and coupled to a network, a sensor coupled to the network and associated with the equipment monitoring the level, and software executing on the computer including an expected condensate level over time expected based on equipment use and temperature and humidity readings. The system is provided such that the sensor measures the condensate level when the spray system is in use and out of use transmitting the condensate level data to the computer.

Various objects of the invention are achieved by a fluid distribution system is provided for controlling distribution of fluid to cooling flow over a condenser of an air conditioning, refrigeration or heat pump system. The distribution system includes a controller, one or more sensors and one or more distribution elements configured to distribute fluid, the one or more distribution elements comprising first distributor and a second distributor. The controller is configured to receive sensor data from the one or more sensors and in response to the sensor data, the controller configured to control one or more fluid distribution elements. When the sensor data indicates temperature above a first threshold value, the controller is configured to distribute fluid into cooling flow for the condenser using the first distributor. When the sensor data indicates temperature below a second threshold value, the controller is configured to adjust the second distributor to drain the fluid distribution system.

Additional objects are achieved by a fluid distribution system for controlling distribution of fluid to cooling flow over a condenser of an air conditioning, refrigeration or heat pump system. The distribution system includes a controller, one or more sensors and one or more distribution elements configured to distribute fluid, the one or more distribution elements comprising first distributor. The controller is configured to receive sensor data from the one or more sensors and in response to the sensor data, the controller configured to control one or more fluid distribution elements. When the sensor data indicates temperature above a first threshold value, the controller is configured to distribute fluid into cooling flow for the condenser using the first distributor. When the sensor data indicates temperature below the first threshold value, the controller is configured to not distribute fluid into the cooling flow.

In certain aspects the first distributor includes a pump. In other aspects the second distributor includes a valve. In other aspects a reservoir is arranged to collect condensed fluid from an evaporator, the reservoir arranged to feed the fluid which is distributed into the cooling flow and the second distributor arranged to drain the reservoir. In other aspects at least a first one of the one or more sensors is arranged to measure a temperature at or adjacent the condenser and sensor data from the first one of the one or more sensors is compared to the first threshold to determine if fluid is distributed into the cooling flow. In still other aspects at least a first one of the one or more sensors is arranged to measure an ambient temperature at or adjacent a unit which includes the condenser and sensor data from the first one of the one or more sensors is compared to the first threshold to determine if fluid is distributed into the cooling flow. In yet other aspects the first threshold comprises at least two threshold values associated with different ones of the one or more sensors and further comprising at least a second one of the one or more sensors is arranged to measure an ambient temperature at or adjacent a unit which includes the condenser and sensor data from the first and second ones of the one or more sensors is compared to corresponding threshold values of the first threshold to determine if fluid is distributed into the cooling flow. In yet other aspects the first distributor is configured to spray water into the cooling flow. In yet other aspects the controller is configured to receive a selection indicative of a refrigerant type used in the condenser and one or more values of the first threshold are based on the selection. In certain aspects the controller is configured to adjust a rate of distribution of the fluid based on the sensor data. In other aspects the rate of distribution of the fluid increases when the sensor data indicates an increase in temperature. In yet other aspects a cleaning agent is configured to be distributed with the fluid onto the condenser via at least one of the one or more distribution elements.

Other aspects and features of the present invention will become apparent from consideration of the following description taken in conjunction with the accompanying drawings.

DETAILED DESCRIPTION

Figure 1:
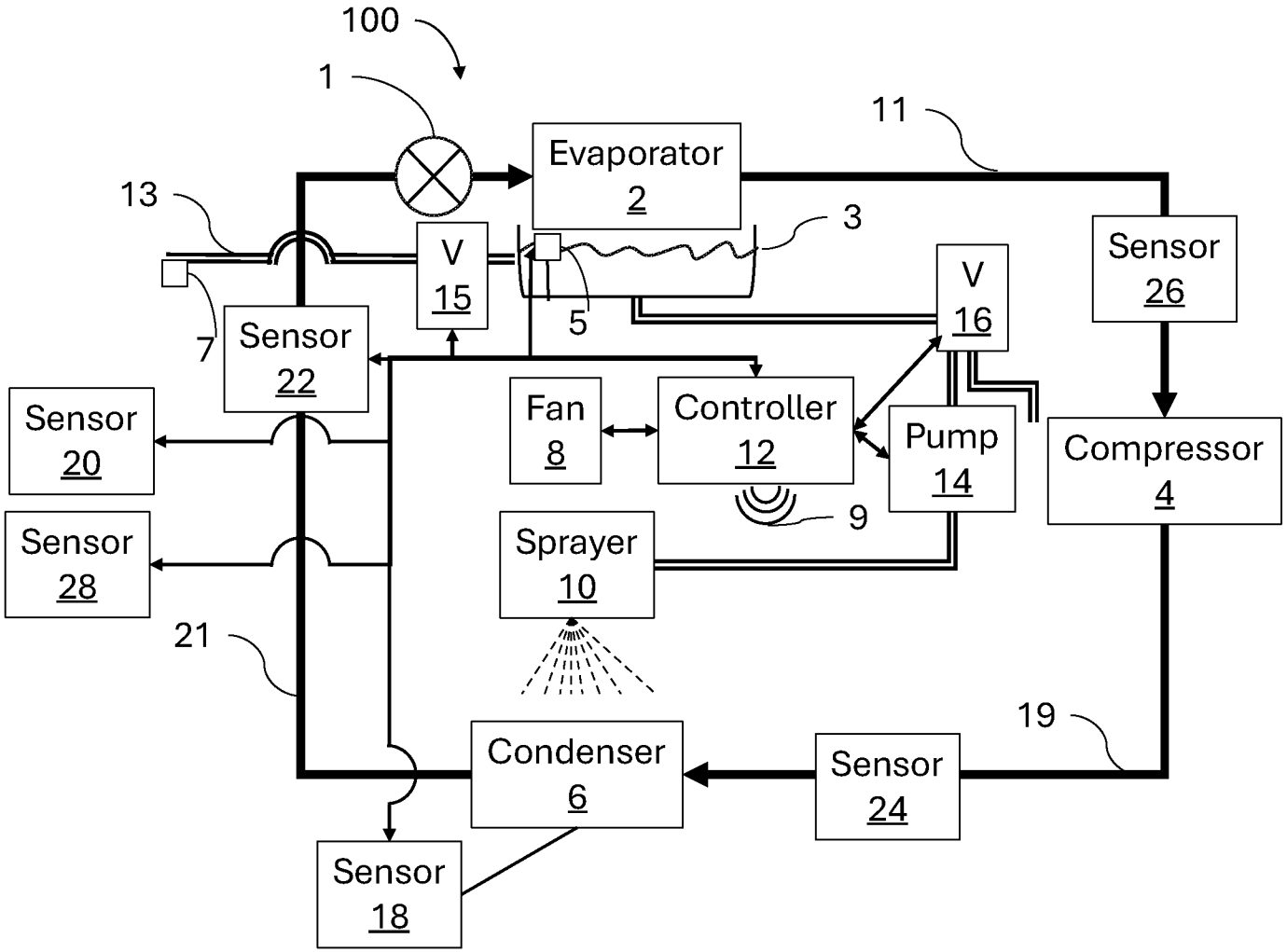
FIG. 1 illustrates an example refrigeration system with the improved sensor and sprayer array.

Referring now to the drawings, wherein like reference numerals designate corresponding structure throughout the views. The following examples are presented to further illustrate and explain the present invention and should not be taken as limiting in any regard.

The vapor-compression refrigeration cycle is the pattern cycle for the great majority of commercially available refrigeration systems. This thermal transfer cycle is customarily accomplished by a compressor, condenser, throttling device and evaporator connected in serial fluid communication with one another. The system is charged with refrigerant, which circulates through each of the components. More particularly, the refrigerant of the system circulates through each of the components to remove heat from the evaporator and transfer heat to the condenser. The compressor compresses the refrigerant from a low-pressure superheated vapor state to a high-pressure superheated vapor state thereby increasing the temperature, enthalpy and pressure of the refrigerant. A superheated vapor is a vapor that has been heated above its boiling point temperature. It leaves the compressor and enters the condenser as a vapor at some elevated pressure where the refrigerant is condensed as a result of the heat transfer to ambient air. The refrigerant then flows through the condenser condensing the refrigerant at a substantially constant pressure. The refrigerant then leaves the condenser and the pressure of the refrigerant is decreased as it flows through the expansion valve, resulting in a temperature drop. The refrigerant temperature then increases through the evaporator as a result of heat transfer from the refrigerated space. This vapor then enters the compressor to complete the cycle.

A system for cooling that sprays condensate over the hot coils to lower the temperature and improve the efficiency of the HVAC unit during peak times will provide a distinct advantage over existing systems. In doing so, the HVAC does not have to run as long to reach the target temperature, and the HVAC runs more efficiently as the coils are cooler and provide better cooling. Particularly, the challenge with refrigerant systems, especially air conditioners is that when the refrigerant leaves the compressor and enters the condenser as a vapor at some elevated pressure, the ability to then condense the refrigerant and provide heat transfer to ambient air is dependent largely on the temperature of the ambient air, with hot temperatures providing for less efficient cooling and forcing the cooling unit to work harder to provide e.g. air conditioned spaces in the building. The head pressure of the refrigerant should be about 325-375 psi in some examples, e.g. with R-410 refrigerant. However, if the ambient air is too hot, this pressure will increase and the system will then have to work harder. At the same time, if the condenser is cooled off too much, the head pressure can get too low and the compressor then is being fed refrigerant in a liquid state and not a gaseous state, causing operational problems. Depending on the refrigerant used in the system, the ideal pressure may be different. Since the systems are closed loops, the temperature and pressure are proportionate and the pressure can be inferred or approximated when knowing the temperature of the refrigerant or something indicative of refrigerant temperature (e.g. the temperature of the condenser). However, since the evaporator will produce water as a byproduct, that water can be misted into the cooling flow from the fan through the condenser so that the water can provide added ability to absorb heat, particularly in phase change from a fine liquid mist to steam, or simply by allowing the liquid to absorb heat at a rate that the ambient air alone could not.

Referring to FIG. 1, the hardware of a normal refrigeration/AC unit 100 is shown with added cooling sprayers and associated controllers and sensors. Particularly, the lines 11 contain refrigerant and compressor 4 compresses that refrigerant fluid. The compressed fluid is fed through the condenser where fan 8 blows air over the condenser. Sensors 18, 20, 22, 24 and 26 are provided to measure the condenser temperature 18, the ambient temperature 20 and the line temperatures 22/24/26. Particularly, the temperature of line 11 may be determined by sensor 26, the temperature of line 19 by sensor 24, the temperature of line 21 by sensor 22. Additional sensors may be provided. Further, pressure sensors may be provided to measure refrigerant pressure in the line, for example, sensors 22, 24 and 26 may have a pressure tap to measure pressure in the line itself and/or temperature in the line itself. Additionally, the controller may be network connected and may receive weather data or other remote sensor data and control instructions as needed. The controller operates the pump 14 and the valve 16 and therefore the sprayer 10 based on sensor readings from sensors 18, 20, 22, 24, 26. If the sensor data indicates the condenser or another component of the system is running hotter than expected, the controller can activate the pump 14 to direct water to the sprayer 10 where it is disbursed into the flow of air from the fan that is blowing over the condenser coil. If the temperature is below that first threshold temperature, this may indicate that the ambient temperature is cold enough or the AC unit is operating efficiently enough that added cooling is not necessary. In this case, the controller would not direct water to the sprayer. Since the AC unit is operating, the evaporator 2 may still be producing liquid water as a byproduct of the cooling/heat transfer. The reservoir 3 then continues to collect condensate. If the reservoir 3 level becomes too high, the controller opens the valve 16 to drain water.

The pump 14 may be variable in that it operates at a variable speed that can increase or decrease the rate of fluid sprayed through the sprayer 10 into the cooling flow. Particularly, at higher temperatures measured by one or more of the sensors 18, 20, 22, 24, the pump 14 may be operated at higher speeds by the controller to provide more fluid flow to the sprayer 10. In this case, since the AC unit is running more frequently and a known volume of air is being cooled, the rate of condensate production can be determined or approximated. For example, sensor 20 may include multiple sensor types, including e.g. humidity. Thus, depending on the temperature and humidity, the controller can determine the rate at which the evaporator 2 will produce condensate liquid and then spray water via the sprayer 10 at an appropriate rate. It may be preferable to use the condensate produced at evaporator for spraying as condensate temperature may be relatively low as compared to a normal water supply.

A water supply would require plumbing lines run to the refrigerator/AC unit, resulting in a more complex installation. Nonetheless, if the condensate produced is insufficient, a supply line 13 may be provided to provide water to the sprayer system and/or to supplement the reservoir. This may be necessary in climates that are both hot and dry. A valve 15 may be controllable by the controller to allow external water from the water supply into the reservoir 3 as needed. The control of the valve may be based on. Float sensor 5 or another type of fluid level sensor may be in communication with the controller 12 and may be used to monitor the water level in the reservoir for purposes of the controller controlling valve 15 to supplement/fill the reservoir 13 and/or for purposes of controlling the pump 14 and the resulting rate of spray of water through the sprayer 10.

The float sensor 5 may also include a temperature sensor to measure the temperature of the condensate in the reservoir 3. The temperature of the condensate in the reservoir 3 may further be used by the controller to determine the rate at which the pump 14 is activated in order to maintain optimal temperature of the condenser 6 as measured by sensor 18 or to maintain optimal temperature of one or more of the lines as measured by sensors 22, 24, and/or 26. Furthermore, the controller can be connected to additional sensors 28 which may be positioned in the space that is being cooled/conditioned and may measure various internal environmental parameters. This may be an existing thermostat, humidity and/or occupancy sensor/light sensor, or a sensor array with a combination of these sensors or other known environmental sensors.

The controller 12 may include a wireless connection 9 such as radio, wifi, Bluetooth or other wireless data connection. This may allow the sensors shown to be connected wirelessely instead of hardwired. The sensor data obtained from the sensors shown can be communicated to a central computer which can monitor and adjust the controller's control logic software.

For example, in situations where the reservoir 3 does not include an external water connection 13, conserving the water for use in peak times may be desirable and this may further be determined based on the electricity rate.

Figure 2:
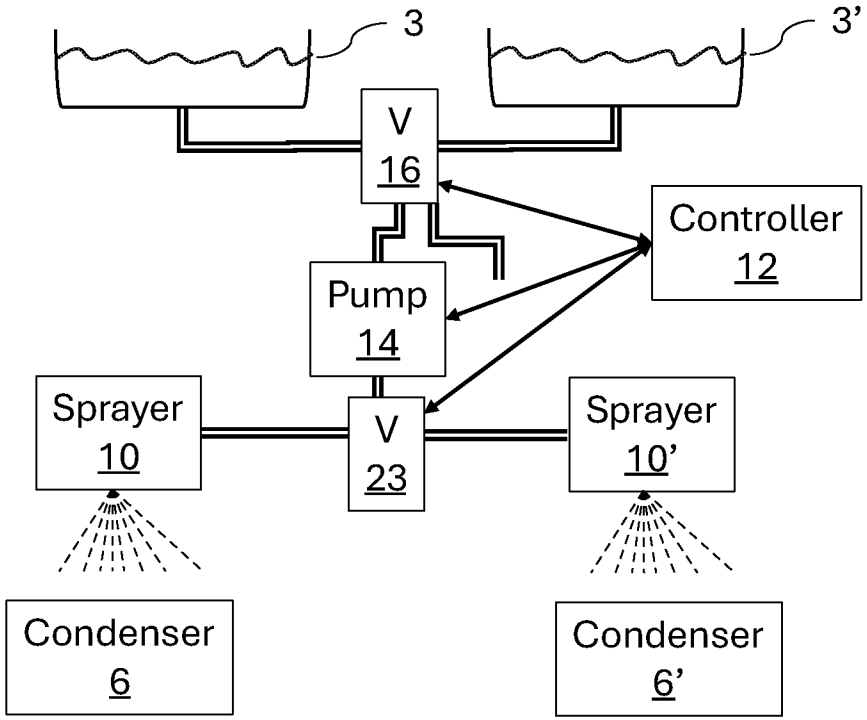
FIG. 2 illustrates an example with multiple refrigerant units according to FIG. 1

Referring to FIG. 2, a simplified diagram showing two AC units with reservoirs 3/3' and condensers 6/6' and sprayers 10/10'. For simplicity the other elements in FIG. 1 corresponding to each AC/refrigeration unit are not shown, but are understood to be present in duplicate form if appropriate or in some cases shared (e.g. the exterior/ambient temperature/humidity sensors may be shared. Here, an additional valve 23 is included in the system and both reservoirs 3/3' feed to the valve 16 which can be used to drain the reservoirs if appropriate. The pump 14 feeds valve 23 which can direct the flow to different sprayers 10/10' in different proportions. This allows for cross feeding, e.g. by reservoir 3' being used to feed sprayer 10 in whole or in part in the case that reservoir 3 is empty. Additional reservoirs are contemplated and may be connected, for example rain water collection may be added as an additional reservoir connected in a similar way to valve 16 as reservoir 3', but without the AC unit features (condenser/sprayer).

Figure 3:
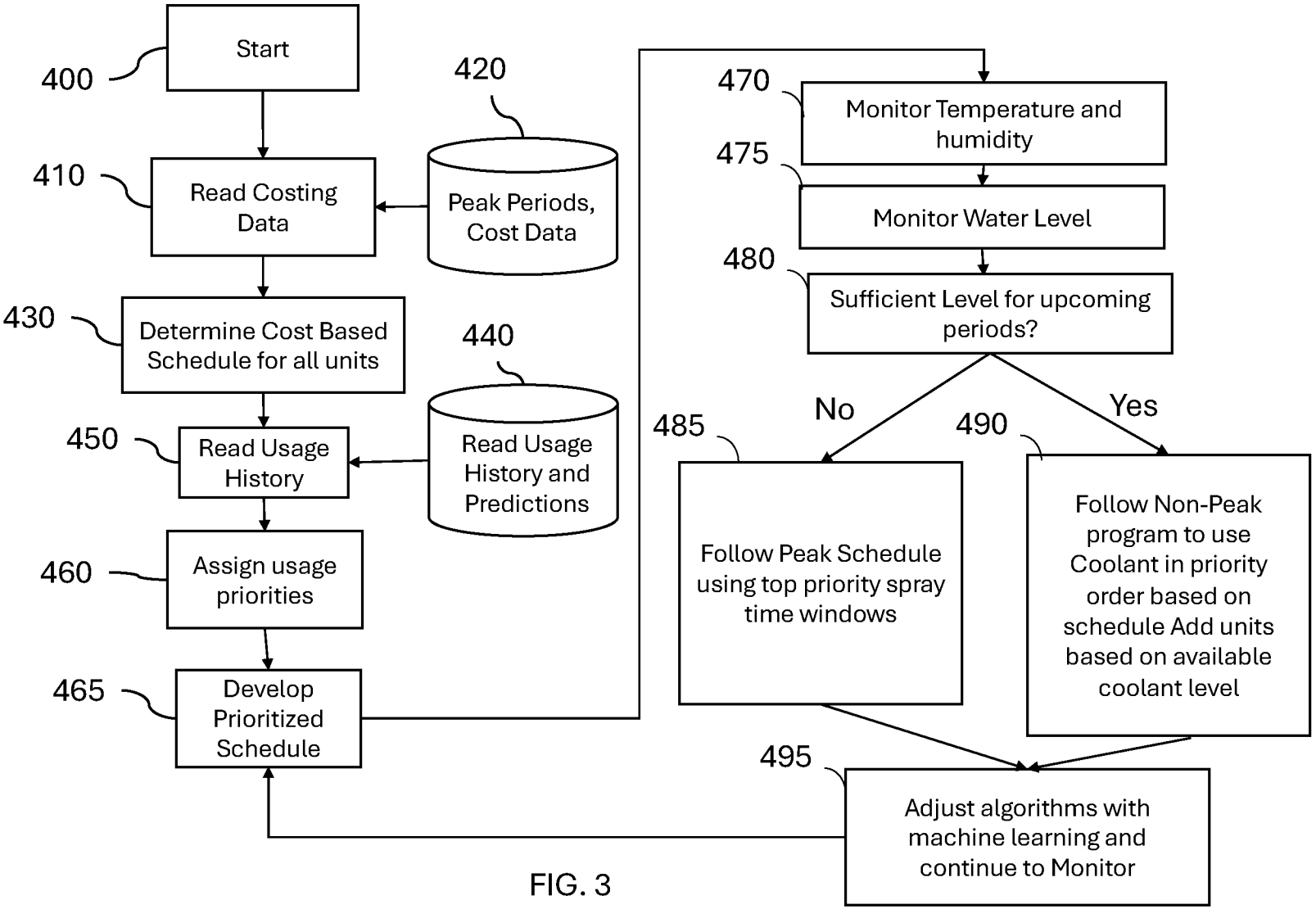
FIG. 3 illustrates an example of the logic flow for condensate spraying according to example embodiments.

FIG. 3 illustrates logic for determining the spray schedules and priorities within the system in an example embodiment. Starting 400 the controller 12 receives and/or reads 410 the cost related data from a data store 420 containing peak usage and rate tables which determine the cost of operating the equipment. This allows the system to determine a cost-based schedule 430 for determining when to spray the equipment. The system also reads usage history 450 from a data store 440 containing historical data on condensate availability and usage and creates predictions about the use and availability of the condensate.

Usage priorities 460 and a prioritized schedule 465 are developed and form the baseline of when to turn on the spraying systems.

The system then monitors outside temperature and humidity 470 as well as the condensate level 475 through the various sensors described herein (see. E.g. FIG. 1). This allows the system to determine if sufficient condensate 480 is available for spraying given the prioritized schedule 465. The rate of condensate production can also be determined by comparing the rate of spray relative to the monitored water level 475.

If sufficient condensate does not exist (i.e. condensate is insufficient), a peak schedule 485 is used to selectively spray the prioritized HVACs at the prioritized time periods based on the availability and expected duration of spray time. This spraying is used most sparingly—spraying only when energy costs are the highest and/or utilization is closest to peak demand.

If sufficient condensate exists, a non-peak program 490 is followed where additional spray windows are used for non-peak times. This algorithm adds windows based on the availability up to an including keeping the sprayers on at all times assuming sufficient condensate.

The monitoring continues 495, and the system adapts its predictions based on sensor information such as whether the condensate has been depleted or if excess condensate remains.

Figure 4:
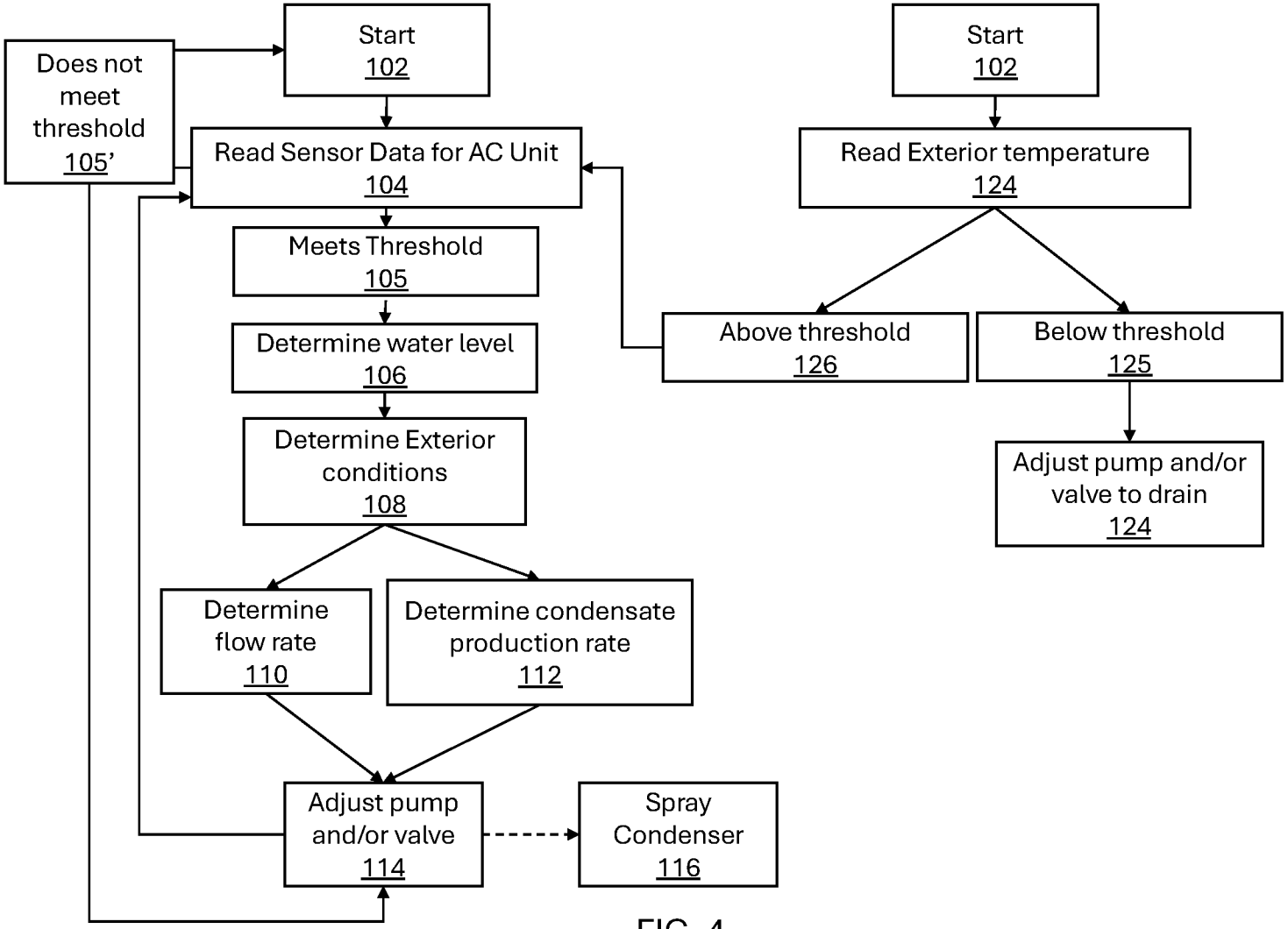
FIG. 4. illustrates an additional example logic flow for condensate spraying according to example embodiments.

Referring to FIG. 4, an example logic flow of machine readable instructions executed by the controller and its associated processor/computer, this shows an example how spraying is determined. The process starts 102 where the exterior temperature is determined 124 in order to decide if it is cold enough to warrant draining the system. If the temperature is below a threshold 125, the pump/valve is adjusted to drain the fluid spray system. If above the threshold, the sensor data for the AC unit is read 104. This may be from any of the sensors previously described, e.g. sensors 18, 20, 22, 24, 26, 28. If the threshold is met 105, this indicates spraying the condenser may be appropriate. The water level is then determined 106 as are the exterior conditions 108. The exterior conditions may be e.g. temperature and humidity which coupled with the controller knowing the rate at which air is being exchanged through the evaporator allows for computation of the condensate production rate 112 which may be actually measured as well when the flow rate is determined 110 and the water level is monitored 106 in a feedback loop. The pump/valve is adjusted 114 and the condenser is sprayed 116. The feedback loop of verifying the threshold is met 105, determining water level 106 etc continues until the threshold is no longer met 105' and the pump is turned off/valve shut 114 and the condenser is not sprayed.

Figure 5:
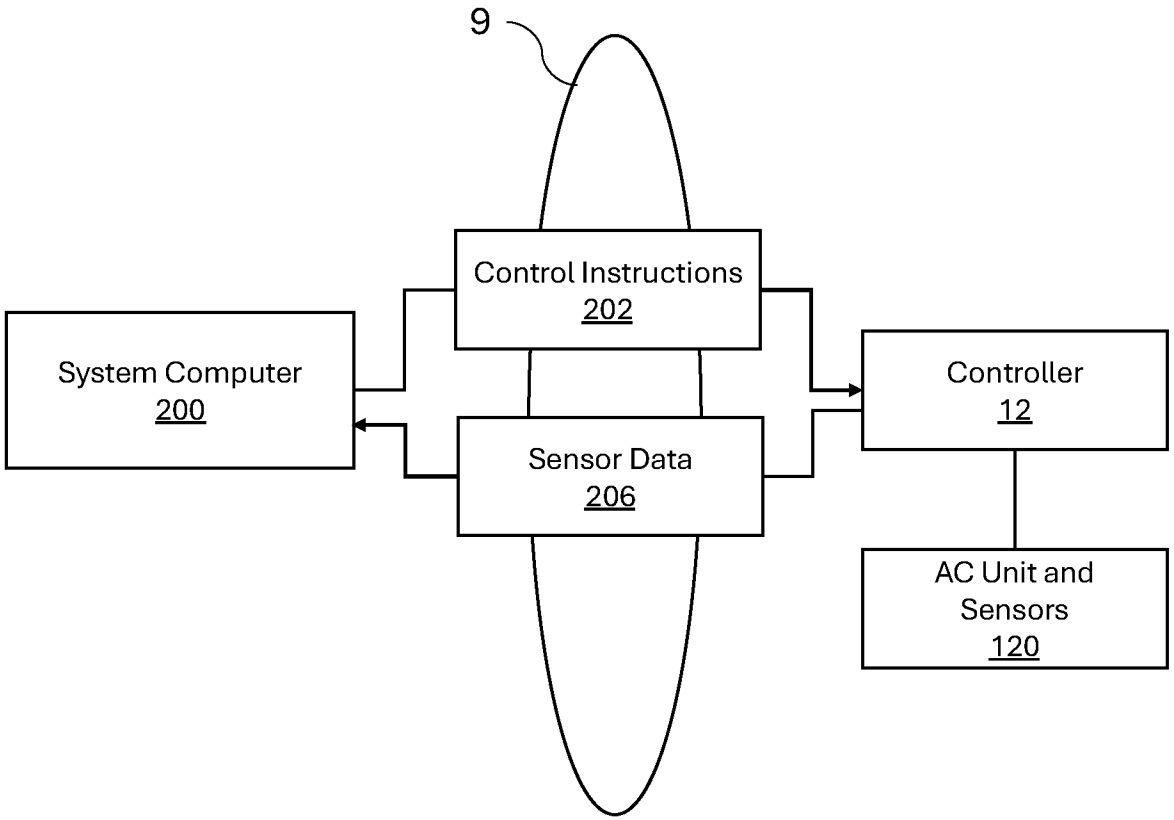
FIG. 5. Provides a functional flow diagram of the AC control system according to example embodiments.

Referring to FIG. 5, an example of the network connection 9 and its ability to connect the controller 12 to a system computer 200 is shown. The system computer may control several spray systems at several different physical locations by providing control instructions 202. The sensor and control data 206 from the controller 12 is provided regarding the various sensors described in FIG. 1 as received from the AC unit(s) and sensors 120 of FIG. 1. The system computer receives rate data (which may also be received over the internet or another network connection) and based on the rate data, the optimal times to spray the condenser can be determined in situations where the condensate may not be in sufficient supply to run the sprayers and pumps at all times appropriate. The control instructions 202 may adjust the thresholds and/or provide additional thresholds for the controller to implement (such as time based and condensate level based thresholds). Thus the software which executes on the system computer can compute and modify the control instructions 202 based on the sensor data 206 and rate data 204. The controller and the software executing on the processor thereof can monitor and send the sensor data and implement the instructions or parameters set by the system computer 200 control instructions 202.

The efficiency gains improve the lifespan of the HVAC, get the room to the desired temperature faster in a cost effective manner as the condensate is created by the system or other systems under normal operation. By employing temperature sensors and thermostats as well as timers, the use of the condensate can be optimally used by targeting the most lucrative periods where savings will yield the best results or efficiency will provide the most comfort in the use of the equipment. For example, especially in systems that do not have an external water supply, when peak evening rates exist and it is expected to be relatively warm overnight, it may be preferable to conserve the condensate at times when the system would normally call for condensate spraying based on the temperature. However, running the AC unit in a less efficient manner at a lower rate in order to save the condensate for use when rates increase may be overall less expensive, depending on the amount of condensate available and the expected ambient temperatures and demand for AC and the resulting supply of condensate during peak rate times. Additionally, the reservoir 3 may be provided with a cleaning solution 300 which is water soluble at a relatively slow rate. This cleaning solution may provide light cleaning by capturing and/or assisting in removal of dust, dirt and debris from the condenser, thus increasing its efficiency and reducing the need for frequent cleanings of the condenser.

In energy billing, there are important cost factors to consider such as peak energy usage, cost of energy at peak times and the occupancy of the space being cooled. For example, large savings can be obtained by reducing peak usage-based demand charges which may affect energy bills in a long-lasting fashion. Using any energy saving solutions at times that can offer maximal cost benefits is paramount to getting the most of out of the efficiencies offered by such systems.

While many of the examples above have been made in connection with cooling equipment for an HVAC system, similar factors can be considered when applied to various different types of equipment including freezers and refrigerators. Any compressor-based cooling system can benefit from the example system as described herein to save energy costs.

Further, while the examples described herein primarily focus on the condensate reuse from the same HVAC which is being cooled, larger deployments can make use of pooled condensate reservoirs applying the timing and spray of the reservoir to those systems that need it the most and at the most opportune time. Further, technologies such as fuel cells or other clean water generating devices can also contribute to the condensate pool.

It will be understood by those of skill in the art that while examples using HVAC are utilized, the same system can be adapted and used for any compressor-based systems, and any systems that can gain efficiency by utilizing a spray of water.

While the invention is susceptible to various modifications, and alternative forms, specific examples thereof have been shown in the drawings and are herein described in detail. Is should be understood however that the invention is not to be limited to the particular forms or methods or embodiments disclosed.

What is claimed:

1. A fluid distribution system for controlling distribution of fluid to cooling flow over a condenser of an air conditioning, refrigeration or heat pump system of an HVAC unit having an evaporator comprising:

a controller;

one or more sensors;

one or more distribution elements configured to distribute fluid, the one or more distribution elements comprising first distributor and a second distributor;

the controller configured to receive sensor data from the one or more sensors and in response to the sensor data, the controller configured to control one or more fluid distribution elements;

a reservoir arranged to collect condensed fluid from the evaporator, the reservoir arranged to feed the fluid which is distributed into the cooling flow and the second distributor arranged to drain the reservoir;

wherein when the sensor data indicates temperature above a first threshold value, the controller is configured to determine an amount of condensate production of the condensed fluid and an amount of the condensate in the reservoir to determine available condensate and the controller distributes the condensed fluid into cooling flow for the condenser using the first distributor based on the available condensate;

wherein when the sensor data indicates temperature below a second threshold value, the controller is configured to adjust the second distributor to drain the fluid distribution system.

2. The system of claim 1 wherein the first distributor includes a pump.

3. The system of claim 1 wherein the second distributor includes a valve.

4. The system of claim 1 further comprising said controller further determining to distribute condensate based on cost of operation of the HVAC unit.

5. The system of claim 1 wherein at least a first one of the one or more sensors is arranged to measure a temperature at or adjacent the condenser and sensor data from the first one of the one or more sensors is compared to the first threshold to determine if fluid is distributed into the cooling flow.

6. The system of claim 5 wherein the first threshold comprises at least two threshold values associated with different ones of the one or more sensors and further comprising at least a second one of the one or more sensors is arranged to measure an ambient temperature at or adjacent a unit which includes the condenser and sensor data from the first and second ones of the one or more sensors is compared to corresponding threshold values of the first threshold to determine if fluid is distributed into the cooling flow.

7. The system of claim 1 wherein at least a first one of the one or more sensors is arranged to measure an ambient temperature at or adjacent a unit which includes the condenser and sensor data from the first one of the one or more sensors is compared to the first threshold to determine if fluid is distributed into the cooling flow.

8. The system of claim 1 wherein the first distributor is configured to spray water into the cooling flow.

9. The system of claim 1 wherein the controller is configured to receive a selection indicative of a refrigerant type used in the condenser and one or more values of the first threshold are based on the selection.

10. A fluid distribution system for controlling distribution of fluid to cooling flow over a condenser of an air conditioning, refrigeration or heat pump system of an HVAC unit having an evaporator comprising:

a controller;

one or more sensors;

one or more distribution elements configured to distribute fluid, the one or more distribution elements comprising first distributor;

a reservoir arranged to collect condensed fluid from the evaporator, the reservoir arranged to feed the fluid which is distributed into the cooling flow and the second distributor arranged to drain the reservoir the controller configured to receive sensor data from the one or more sensors and in response to the sensor data, the controller configured to control one or more fluid distribution elements;

wherein when the sensor data indicates temperature above a first threshold value, the controller is configured to determine an amount of condensate production of the condensed fluid and an amount of the condensate in the reservoir to determine available condensate and the controller distributes the condensed fluid into cooling flow for the condenser using the first distributor based on the available condensate;

wherein when the sensor data indicates temperature below the first threshold value, the controller is configured to not distribute fluid into the cooling flow.

11. The system of claim 10 wherein when the sensor data indicates temperature below a second threshold value, the controller is configured to adjust a second distributor to drain the fluid distribution system.

12. The system of claim 11 wherein the second distributor includes a valve.

13. The system of claim 10 wherein the first distributor includes a pump.

14. The system of claim 10 further comprising said controller further determining to distribute condensate based on cost of operation of the HVAC unit.

15. The system of claim 10 wherein at least a first one of the one or more sensors is arranged to measure a temperature at or adjacent the condenser and sensor data from the first one of the one or more sensors is compared to the first threshold to determine if fluid is distributed into the cooling flow.

16. The system of claim 15 wherein the first threshold comprises at least two threshold values associated with different ones of the one or more sensors and further comprising at least a second one of the one or more sensors is arranged to measure an ambient temperature at or adjacent a unit which includes the condenser and sensor data from the first and second ones of the one or more sensors is compared to corresponding threshold values of the first threshold to determine if fluid is distributed into the cooling flow.

17. The system of claim 10 wherein at least a first one of the one or more sensors is arranged to measure an ambient temperature at or adjacent a unit which includes the condenser and sensor data from the first one of the one or more sensors is compared to the first threshold to determine if fluid is distributed into the cooling flow.

18. The system of claim 10 wherein the controller is configured to receive a selection indicative of a refrigerant type used in the condenser and one or more values of the first threshold are based on the selection.

19. The system of claim 10 wherein the controller is configured to adjust a rate of distribution of the fluid based on the sensor data.

20. The system of claim 19 wherein the rate of distribution of the fluid increases when the sensor data indicates an increase in temperature.

21. The system of claim 10 further comprising a cleaning agent configured to be distributed with the fluid onto the condenser via at least one of the one or more distribution elements.

* * * * *